US009363605B2

(12) United States Patent
Goodman et al.

(10) Patent No.: US 9,363,605 B2
(45) Date of Patent: Jun. 7, 2016

(54) FOCUSED ACOUSTIC TRANSDUCER

(75) Inventors: George David Goodman, Phoenixville, PA (US); Voldi E. Maki, Jr., Austin, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 287 days.

(21) Appl. No.: 13/980,266

(22) PCT Filed: Jan. 18, 2011

(86) PCT No.: PCT/US2011/021507

§ 371 (c)(1),
(2), (4) Date: Jul. 17, 2013

(87) PCT Pub. No.: WO2012/099573

PCT Pub. Date: Jul. 26, 2012

(65) Prior Publication Data

US 2013/0294203 A1 Nov. 7, 2013

(51) Int. Cl.
*H04R 17/00* (2006.01)
*H04R 31/00* (2006.01)

(52) U.S. Cl.
CPC ..... *H04R 17/00* (2013.01); *H04R 31/00* (2013.01)

(58) Field of Classification Search
CPC ..... H04R 17/00; H04R 31/00; B06B 1/06; B06B 1/0625; G01V 1/40; G01V 1/52
USPC ..... 367/164
See application file for complete search history.

(56) References Cited

U.S. PATENT DOCUMENTS 3,086,195 A 4/1963 Halliday
3,470,457 A 9/1969 Howlett (Continued)

FOREIGN PATENT DOCUMENTS

GB 899474 6/1962
GB 2500359 9/2013

(Continued)

OTHER PUBLICATIONS

Millman, Jacob "Microelectronics; Digital and Analog Circuits and Systems", McGraw-Hill, Figures 16-8, 16-10(a), 16-11, 17-28, (1979),pp. 573-577 and 654.

(Continued)

*Primary Examiner* — Mark Hellner
(74) *Attorney, Agent, or Firm* — Krueger Iselin LLP; Benjamin Fite

(57) ABSTRACT

A focused acoustic transducer suitable for use in a downhole environment is disclosed. At least some embodiments employ a disk of piezoelectric material with low planar coupling and low Poisson's ratio mounted on a backing material and sealed inside an enclosure. The piezoelectric material disk has a pattern of electrodes deposited on an otherwise smooth, ungrooved surface. Despite the lack of grooves, the material's low planar coupling and low Poisson's ratio enables the electrodes to operate in a phased relationship to provide and receive focused acoustic pulses. Moreover, the elimination of deep cuts offers a much lower cost of construction. The electrode material may be any conductive material, though silver and silver alloys are contemplated. The patterning of electrodes can occur during the deposition process (e.g., using a silk-screen or other printing technique) or afterwards (e.g., mechanically or chemically with an etch technique that uses a pre- or post-deposition photoresist layer).

20 Claims, 4 Drawing Sheets

(56) References Cited

U.S. PATENT DOCUMENTS

| | | | | |
|---|---|---|---|---|
| 4,012,952 | A | 3/1977 | Dory | |
| 4,241,611 | A | 12/1980 | Specht et al. | |
| 4,532,615 | A | 7/1985 | Ballinger | |
| 4,677,367 | A | 6/1987 | Goodman | |
| 5,044,462 | A | 9/1991 | Maki | |
| 5,122,993 | A * | 6/1992 | Hikita et al. | 367/155 |
| 5,142,511 | A | 8/1992 | Kanai et al. | |
| 5,359,180 | A | 10/1994 | Park et al. | |
| 5,570,024 | A | 10/1996 | Vail et al. | |
| 5,596,534 | A | 1/1997 | Manning | |
| 5,861,771 | A | 1/1999 | Matsuda et al. | |
| 5,992,223 | A | 11/1999 | Sabins et al. | |
| 6,268,726 | B1 | 7/2001 | Prammer et al. | |
| 6,353,277 | B1 * | 3/2002 | Hahn-Jose | 310/324 |
| 6,362,619 | B2 | 3/2002 | Prammer et al. | |
| 6,518,756 | B1 | 2/2003 | Morys et al. | |
| 6,583,621 | B2 | 6/2003 | Prammer et al. | |
| 6,636,406 | B1 | 10/2003 | Anthony | |
| 6,815,930 | B2 | 11/2004 | Goodman | |
| 6,825,659 | B2 | 11/2004 | Prammer et al. | |
| 6,930,616 | B2 | 8/2005 | Tang et al. | |
| 6,975,112 | B2 | 12/2005 | Morys et al. | |
| 7,154,412 | B2 | 12/2006 | Dodge et al. | |
| 7,463,027 | B2 | 12/2008 | Prammer et al. | |
| 7,696,756 | B2 | 4/2010 | Morys et al. | |
| 7,733,086 | B2 | 6/2010 | Prammer et al. | |
| 2007/0103161 | A1 | 5/2007 | San Martin et al. | |
| 2009/0174288 | A1 * | 7/2009 | Theuerkauf | 310/337 |
| 2009/0309591 | A1 | 12/2009 | Goodman et al. | |
| 2013/0294203 | A1 * | 11/2013 | Goodman et al. | 367/164 |

FOREIGN PATENT DOCUMENTS

| | | |
|---|---|---|
| WO | WO-2005/059285 | 6/2005 |
| WO | WO-2007/055790 | 5/2007 |
| WO | WO-2012/099573 | 7/2012 |

OTHER PUBLICATIONS

PCT International Search Report and Written Opinion, dated May 2, 2007, Appl No. PCT/US2006/034738, "Oil Based Mud Imaging Tool with Common Mode Voltage Compensation", filed Sep. 7, 2006, 10 pgs.

PCT International Search Report and Written Opinion, dated Jul. 11, 2008, Appl No. PCT/US2006/034959, "Displaced Electrode Amplifier", filed Sep. 8, 2006, 5 pgs.

PCT International Preliminary Report on Patentability, dated Mar. 26, 2009, Appl No. PCT/US2006/034959, "Displaced Electrode Amplifier", filed Sep. 8, 2006, 2 pgs.

PCT International Preliminary Report on Patentability, dated Jul. 17, 2008, Appl No. PCT/US2006/060774, "Displaced Electrode Amplifier", filed Nov. 10, 2006, 2pgs.

Brown, J. A., et al., "Design and Fabrication of Annular Arrays for High Frequency Ultrasound", IEEE Transactions on Ultrasonics, Ferroelectrics, and Frequency Control, vol. 51, No. 8, Aug. 2004., 8 pgs.

Piezo Technologies, "Piezo Technologies Material Properties 2010", 2010 PiezoTech, LLC, http:/www.PiezoTechnologies.com/pdf/keramos-material-specs.pdf, revised Sep. 2010., 1 pg.

Morys, Marian et al., "Field Testing of an Advanced LWD Imager for Oil-Based Mud Applications", SPWLA 51st Annual Logging Symposium, Jun. 19-23, 2010, pp. 1-13.

Morys, Marian L., et al., Appl No. PCT/US2006/034738, Oil Based Mud Imaging Tool with Common Mode Voltage Compensation, filed Sep. 7, 2006, 24 pgs.

PCT International Search Report and Written Opinion, dated Mar. 14, 2011, Appl No. PCT/US2011/021507, "An Improved Focused Acoustic Transducer", filed Jan. 18, 2011, 9 pgs.

PCT International Preliminary Report on Patentability, dated Feb. 26, 2013, Appl No. PCT/US2011/021507, "An Improved Focused Acoustic Transducer", filed Jan. 18, 2011, 9 pgs.

SG Written Opinion, dated Jul. 7, 2014, 2013053012, "An Improved Focused Acoustic Transducer," Filed Jan. 18, 2011, 13 pgs.

* cited by examiner

FOCUSED ACOUSTIC TRANSDUCER

BACKGROUND

After a borehole is drilled, it is often useful to gain information about the quality and condition of certain areas of the wellbore. One way to obtain this information is through use of the borehole imaging system. The borehole imaging system provides an output signal, which is indicative of the nature of the borehole. The surface is illuminated with acoustic pulses and the acoustic pulse return signal is used in some fashion to obtain an indication of the surface of the surrounding borehole. This procedure is normally carried out in an open-hole condition where the well is filled with drilling fluid. The wall is intended to be at a controlled and specific distance from the transducer, which transmits and then receives the acoustic pulse. For optimum resolution, the acoustic energy is focused at some specific distance from the logging tool.

It is expected that focusing the acoustic energy will provide two advantages. First, the return signal from a focused acoustic pulse generally has a higher amplitude, which improves the signal-to-noise ratio of the measurement. Second, the focused pulse provides the measurements with increased distance sensitivity, which translates into an improved depth of field. Such sensitivity improves the system's response to surface roughness and other rugosity. Both of these anticipated advantages would contribute to improved detection of formation characteristics, boundaries between formation beds, and faults or other voids intersected by the borehole.

One way to focus the acoustic energy is to employ an annular ring transducer such as that described in U.S. Pat. No. 5,044,462 titled "Focused Planar Transducer" and filed Jul. 31, 1990 by inventor V. Maki. However, this and other existing annular ring transducer designs require deeply cut grooves for their operation. Previous fabrication methods cut grooves with a minimum depth of 80% of the piezoelectric material thickness to form annular rings at the surface. Such grooves can be difficult and expensive to cut, and may be expected to reduce yield and reliability.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

The issues identified in the background above can be addressed, at least in part, by devices and methods employing an improved focused acoustic transducer. In at least one embodiment, a focused acoustic transducer for use in a downhole environment includes a disk of piezoelectric material with low planar coupling and low Poisson's ratio mounted on a backing material and sealed inside an enclosure. The piezoelectric material disk has a pattern of electrodes deposited on an otherwise smooth, ungrooved surface. Despite the lack of grooves, the material's low planar coupling and low Poisson's ratio enables the electrodes to operate independently and provide focused acoustic pulses similar to those created by cut or deeply grooved transducers from the prior art. Moreover, the elimination of deep cuts offers a much lower cost of construction.

In at least some embodiments, the focused acoustic transducer is created by depositing a layer of silver or other conductive material on opposite surfaces of planar pieces of piezoelectric material. The conductive layer on one side provides a ground or reference electrode and the conductive layer on the other side can be patterned into annular rings or other desired shapes. This patterning can occur during the deposition process (e.g., using a silk-screen or other printing technique) or afterwards (e.g., with an etch technique that uses a pre- or post-deposition photoresist layer). The patterns may also be cut into the electrode material using mechanical processes. Wires or conductive lines are then provided to couple each electrode to phased transmit and receive electronics that provide for the creation of a focused acoustic wave.

In at least one system embodiment, the focused acoustic transducer is part of a borehole imaging system that further includes a logging tool with a processor coupled to a telemetry system. The processor is coupled to the planar focused transducer to generate an acoustic signal by driving the pattern of electrodes in a phased manner. In addition, the processor is further configured to receive an acoustic signal by combining signals from the pattern of electrodes in a phased way. Characteristics of the received acoustic signal are measured and communicated to the surface where they can be displayed as a log or image of the borehole wall.

Figure 1:
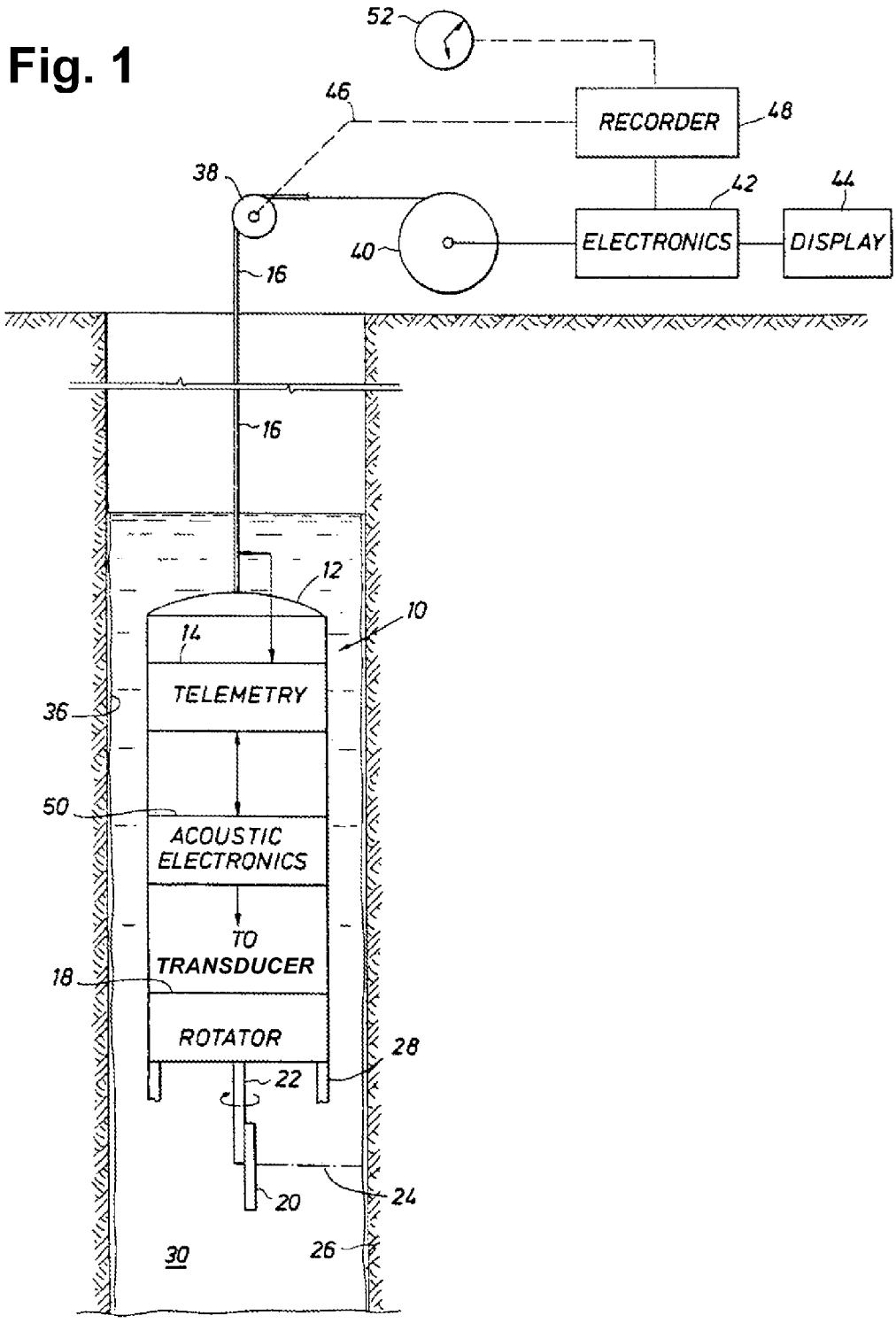
FIG. 1 shows an illustrative borehole imaging system.

Turning now to the figures, FIG. 1 shows an illustrative borehole imaging system. The numeral 10 identifies an acoustic measuring device supported in a sonde 12. The sonde 12 encloses a telemetry system 14, which provides an output signal on a logging cable 16 that extends to the surface. The sonde 12 includes a rotator 18 for rotating a transducer 20 in accordance with the present disclosure. The transducer is mounted on a rotatable mechanism 22 so that the emitted acoustic pulse travels radially outwardly along a propagation line 24 and impinges on the sidewall 26 of the borehole. The sonde 12 is constructed with a housing 28, which is elongate and cylindrical. The transducer 20 is preferably submerged in the borehole fluid 30 to provide better acoustic coupling, though operation in air is possible and contemplated.

Although the well borehole 26 has been represented as a relatively smooth surface, it can be irregular depending on the nature of the drilling process and the nature of the formations penetrated by the borehole 26.

The conductor 16 extends to the surface where it passes over a sheave 38. The sheave 38 directs the logging cable 16 to a drum 40 where it is spooled for storage. The conductors in the cable 16 are connected with surface located electronics 42. In at least some embodiments, the surface electronics 42 take the form of a digital controller or a general purpose digital processing system such as a computer, and they operate on the received signals to map the measured characteristics of the acoustic signals to the corresponding position and orientation of the transducer 20 in the borehole to form a log or image of the borehole wall. The output data is displayed on a display 44. The data is recorded electronically 48, simultaneously with depth and time. The time is obtained from a real time clock 52 with millisecond resolution. The depth may be provided by an electrical or mechanical depth measuring apparatus 46 which is connected with the sheave 38 and which also connects to the recorder 48. Alternatively, position and orientation sensors can be provided in the downhole tool. Such sensors can include accelerometers, gyroscopes, magnetometers, and inertial tracking systems.

The present apparatus further includes acoustic electronics 50 which are supported in the sonde 12 and coupled to transducer 20. Though the transducer in FIG. 1 is shown rotating relative to the body of the sonde 12, other embodiments have the transducer affixed to a rotating sonde body. While FIG. 1 shows a wireline embodiment, the focused acoustic transducer can alternatively be employed in a logging-while-drilling (LWD) tool that communicates with the surface via a LWD telemetry system. As the drill string rotates and extends the borehole, the acoustic transducer scans the borehole wall in a helical pattern. Depending on the relative rates of rotation and axial motion, the acoustic imaging tool may be able to collect multiple measurements, which can be combined to make more accurate measurements for each pixel in the resulting borehole wall image or each point in the log of acoustic properties of the formation.

Figure 2:
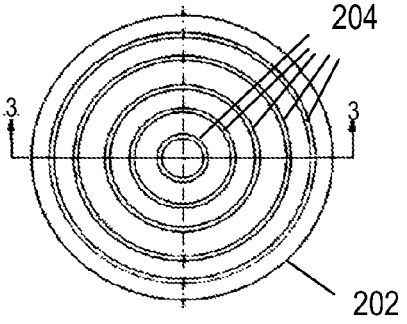
Fig. 2 (Prior Art)
FIG. 2 shows one embodiment of an existing annular ring transducer.
Figure 3:
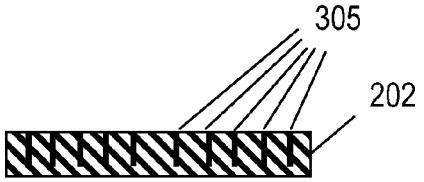
Fig. 3 (Prior Art)
FIG. 3 shows a cross-section of the transducer in FIG. 2.

FIG. 2 is a diagram of an existing annular ring transducer. In this transducer embodiment, a disk of piezoelectric material 202 is cut with annular grooves 204. The piezoelectric disk member has a circular shape and the grooves have a depth of at least 80% of the transducer's thickness. As FIG. 3 shows in a cross-section of disk 202, the grooves 305 need not fully penetrate the ceramic disk. Rather, they are made deep enough to substantially isolate the acoustic and electrical excitations of one ring from the next, while leaving enough of a mechanical connection to maintain the spatial arrangement of the rings during the manufacturing process. The illustrated transducer has a circular center region surrounded by a sequence of five annular rings. The center and ring regions are each coated with an electrically conductive electrode material. Electrical attachments are made to the electrodes using solder or conductive epoxy. A ground wire is attached to the back surface before the ceramic is bonded to the backing material.

Figure 4:
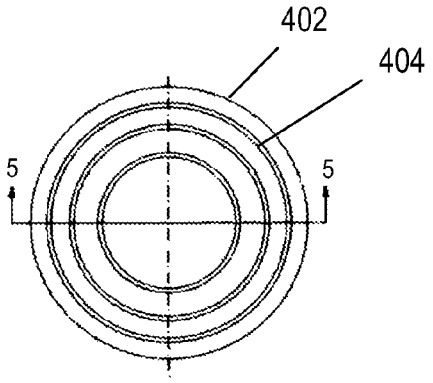
FIG. 4 shows an illustrative focused acoustic transducer.
Figure 5:
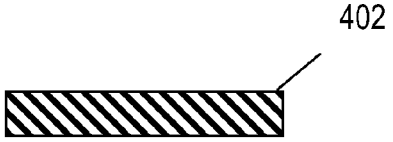
FIG. 5 shows a cross-section of the illustrative transducer in FIG. 4.

An improved focused acoustic transducer 402 is illustrated in FIGS. 4 and 5. The annular spaces 404 that define the annular electrodes are created by patterning or etching the electrode material only and not by cutting deep grooves into the piezoelectric material. (In some manufacturing methods, there may be incidental (shallow) grooves produced by overexposure to the etching solution, but such incidental grooves are not expected to exceed 10% of the thickness of the material.) The transducer relies on the low planar coupling and low Poisson's ratio of the piezoelectric material to isolate the acoustic excitations of the rings rather than deep grooves or kerfs. One suitable piezoelectric material is lead metabionate (e.g., material K-81 or K-91 sold by Piezo Technologies of Indianapolis, Ind.). Other transducer materials may be selected in accordance with good engineering practice in the design of high temperature transducer modules. The normal operating frequency can be anywhere from 50 kHz to 500 kHz. The thickness of the ceramic can be adjusted in some embodiments to achieve a center frequency of 350 kHz+/−5% (e.g., roughly 0.17 inches or 0.4 cm for K-81). Concentric electrode surfaces can be produced by cuts through a whole-surface electrode deposited on the ceramic and possibly a small depth into the ceramic, no more than 10% into the substrate. Alternatively, the electrode surfaces can be printed or patterned as the electrode material is deposited on the surface of the ceramic disk. Each isolated electrode surface is connected to a wire leading out of the back of the transducer package. The electrode on the opposite side is the common electrode, which is also connected to a wire leading out the back of the transducer package. Contemplated electrode materials include silver, silver alloys, gold, and aluminum, though in principle any conductive material can be used to form the electrodes.

The illustrative transducer is expected to withstanding harsh, downhole environment conditions. For example, the presented transducer may experience a normal operating pressure range of up to 20,000 to 30,000 psi gauge pressure, and may be expected to survive without permanent degradation following exposures to 30,000 psi gauge pressure. Further, the expected operating temperature range of the transducer may be a range of 150° to 200° C., and no permanent degradation is expected to result from storage or operation at temperatures between −40 to 185° C. Moreover, the transducer assembly is expected to withstand vibration levels of 15-25 G rms from 5 Hz to 500 Hz. In regards to shock, the transducer assembly may be expected to remain operable after shock levels up to 1000 G's. For some tool embodiments, the ceramic has a thickness of about 0.17 inches and a diameter of about 1.25 inches. The ceramic thickness to diameter ratio is about 0.12, though any value above 0.0625 may be regarded as acceptable.

Figure 6:
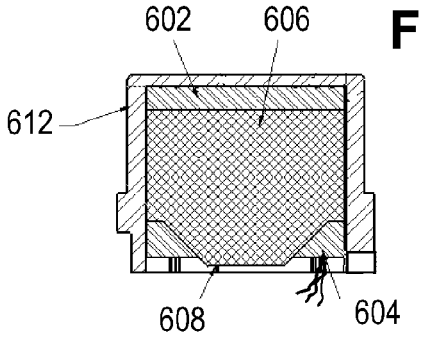
FIG. 6 shows an illustrative focused acoustic transducer package.

FIG. 6 shows an illustrative embodiment of a fully packaged transducer. The illustrated transducer has a solid backing 606, which acts as a highly attenuative medium absorbing the acoustic energy which is radiated into it. The ceramic 602 and backing 606 are enclosed in a housing 612 having a small thickness separating the ceramic 606 from the borehole fluid. This material has a proper acoustic impedance, and is a well known technique for improving the transfer of acoustic energy from the ceramic which has a high impedance to the borehole fluid (e.g., water) which can have a lower impedance. In at least some embodiments, the housing 612 is made from a glass-filled PolyEther Ether Ketone (PEEK) and encapsulates the transducer. In the illustrated embodiment the backing material 606 is a tungsten-polymer mix. The tungsten polymer mix may be formed from a mixture of Viton, tungsten crystalline powder, and tungsten powder. The coupled wires 604 are routed between the electrodes. To improve pressure performance all compressible gasses may evacuated and replaced by a fluid such as oil, and a passage 608 can be provided for this purpose.

Figure 7:
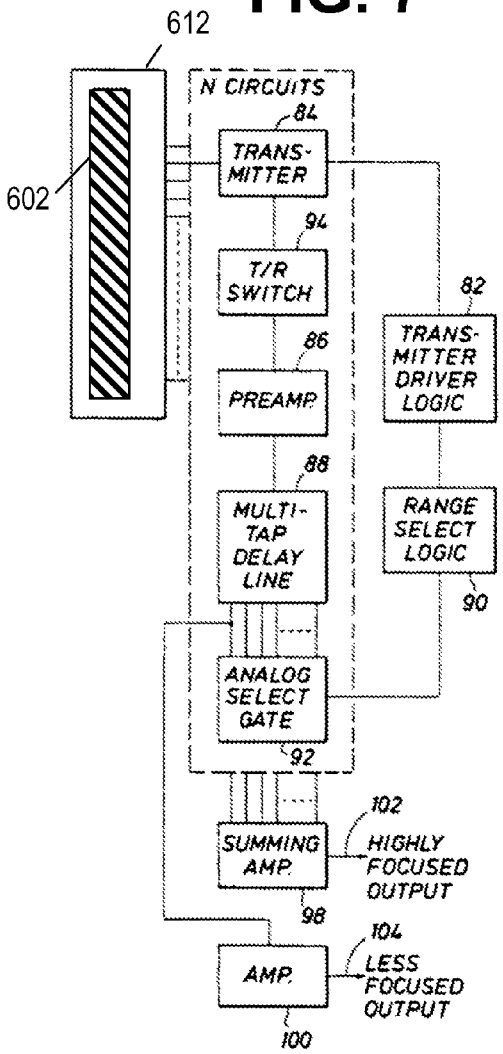
FIG. 7 shows illustrative transmitter and receiver electronics.

FIG. 7 shows an illustrative set of electronics for driving the focused acoustic transducer. The electronics employ the annular electrodes in a phased relationship to transmit and receive focused acoustic energy. Each of the rings (ranging from the smallest on the inside to the largest on the exterior) is used as a separate transmitting transducer. They are each connected to their own dedicated transmitter and receiver units. For example, if there are five rings in the acoustic transducer assembly (including a center electrode), then five duplicate circuits are provided. The phase delays used by the electronics determine the focal distance of the transducer, both for the transmit mode and the receive mode. The transmit focus may be controlled independently from the receive focus. The transmit pulse is delayed by the difference in travel time required for the acoustic energy to propagate from each ring to the desired focal point as the ring diameter decreases. The outer ring typically has no delay, and the inner disk has the most delay. The signal out of the transmitter circuit may be either a single pulse or a burst (typically a square wave) signal at the resonant frequency of the transducer. Again, the signal from the center disk will typically be delayed the most since it will be the closest to the focus, and the outer ring signal will be delayed the least since it is the farthest from the focus. As the focal distance increases, the total range of delays decreases. The acoustic electronics 50 include the range select logic 90 which determines the focal distance. The transmit focal distance is sent to the timing driver logic 82 which controls the signals going to each of the transmitter circuits 84. The transmit/receive switches 94 are used to protect the preamp circuits 86 from the high voltage transmit pulse.

When the transmit/receive switch is in the receive position, the receive signals pass through a delay line 88 having taps at different signal delays. (Alternatively, the signals can be digitized and the multi-tap delay line implemented digitally.) The range select logic 90 controls the tap selection and thereby controls the delays which determine the receiver focal distance. The appropriately-delayed signals from each of the electrodes are summed in the summing amplifier 98 to produce the focused signal output 102. A second output 104 is also made available which is the signal from only the center element, amplified by amplifier 100. The peak of the envelope of the signal 102 forms the amplitude signal. The time location of the onset of this signal is used to derive the travel time, indicating the range to the borehole wall. This forms the typical output signal provided to the surface through the telemetry so that the borehole imaging system presents an image of what is seen by the equipment in the borehole.

Figure 8:
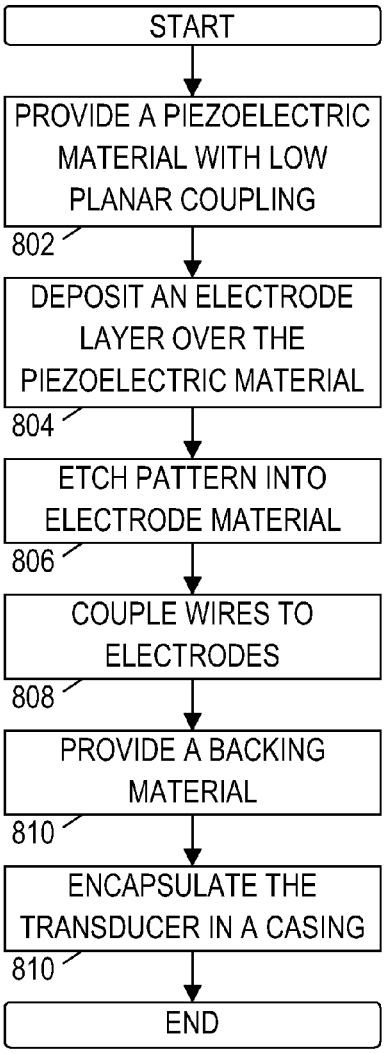
FIG. 8 is a flow diagram of an illustrative fabrication method.

FIG. 8 shows an illustrative fabrication process for the focused acoustic transducer. In block 802, a piezoelectric material with reduced or low planar coupling is provided. One suitable piezoelectric material is lead metabionate, which has a planar coupling coefficient ($k_{31}$) of less than 0.05 and Poisson's ratio of less than 0.2. Other materials with higher planar coupling coefficient values (e.g., up to about 0.1) and Poisson ratios (e.g., up to about 0.25) can be used, though such materials would place greater demands on the performance of the driving electronics. The material is given a circular shape with no grooves, cuts, or kerfs. In block 804 an electrode material is deposited (e.g., silver). In block 806, the electrode material is etched into an annular ring pattern. Next, the wires are coupled to the electrodes in block 808 before the transducer is mounted on a backing material (e.g., a tungsten-polymer mix) in block 810. Finally, in block 812, the transducer and backing material are encapsulated in a sealed housing (e.g., PEEK). The encapsulation process may include the provision of pathways for pressure compensation oil to displace any compressible gasses from the housing. Teflon tape may be used to create these pathways. An epoxy having low shrinkage such as Duralco 4700 or equivalent is appropriate for encapsulation. Pressure compensation oil may be allowed to permeate the ceramic and backing before encapsulation. Preferably at least 65% of the cylindrical surface of the backing is bonded to the PEEK housing to ensure the structural integrity of the device. An alternative material for the backing could be used. For example, Viton could be replaced with an epoxy such as Duralco 4538.

As another alternative, other polymers used in the construction of the transducer could be compatible with specific environmental conditions. Duralco 4460, Duralco 4700, Duralco 4538, Duralco 120, 124 or equivalent, high temp epoxy, rated to at least 185° C. can be used where appropriate. Procedures can be used to minimize the formation of voids in the epoxy and backing material. Epoxies should be fully degassed where appropriate (by stirring under vacuum) prior to their use.

As an alternative to lead metaniobate, an equivalent material with a low planar coupling and low Poisson's ratio and that can withstand very high temperatures while maintaining extremely stable piezoelectric activity can be used. For example, bismuth titanate is also suitable and may be preferred if the temperature requirements are much higher. Bizmuth titanate has a slightly higher planar coupling coefficient and Poisson's ratio, but can withstand very high temperatures while maintaining extremely stable piezoelectric activity. Other materials with high stability of dielectric constant and piezoelectric constant at various temperatures and pressures will be suitable for an equivalent.

Figure 9:
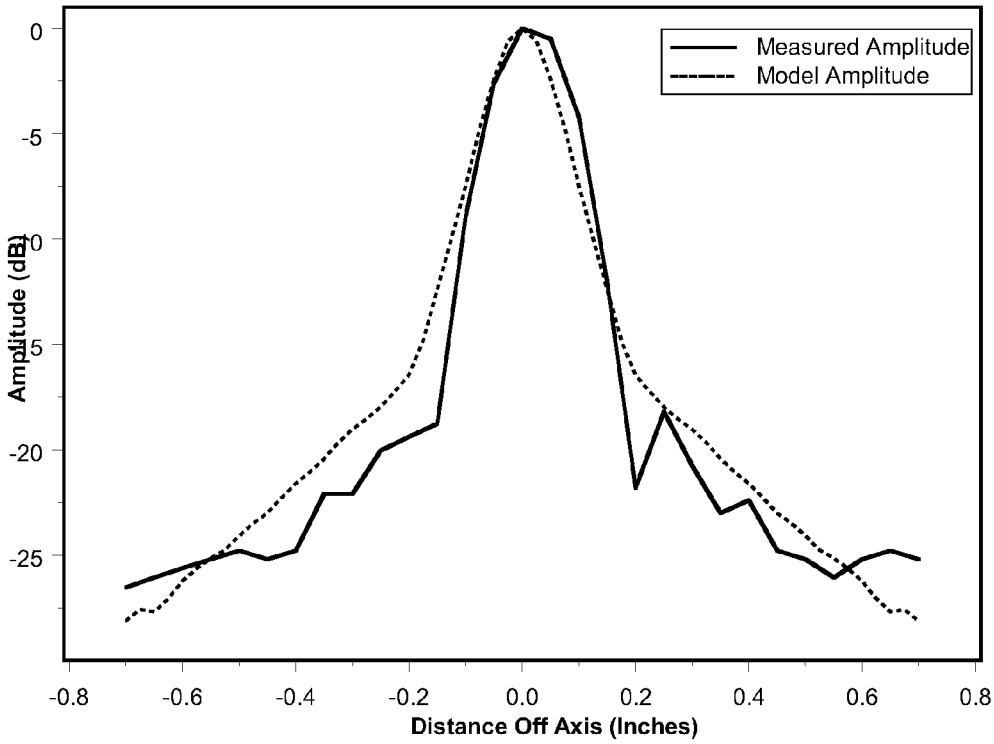
FIG. 9 is a graph demonstrating operation of a planar, ungrooved transducer.

FIG. 9 shows calculated and measured responses for a transducer designed to focus the acoustic signal at a distance 0.48 times the diameter of the transducer. The vertical axis is the signal amplitude in dB. The horizontal axis is the distance from the centerline of the transducer. The solid line represents the measured amplitude while the broken line represents the computed response. The close correspondence between the actual response and the computed response indicate that the desired performance can be achieved without cutting deep grooves into the piezoelectric material.

These and other variations and modifications will become apparent to those skilled in the art once the above disclosure is fully appreciated. It is intended that the following claims be interpreted to embrace all such variations and modifications.

What is claimed is:

1. A focused acoustic transducer that comprises:

a disk of piezoelectric material having a flat, smooth surface on both sides, wherein said piezoelectric material has a planar coupling coefficient of less than 0.05 and Poisson's ratio less than 0.2;

a pattern of electrodes laid over said piezoelectric material, wherein said pattern of electrodes operates in a phased relationship to transmit a focused acoustic wave.

2. The transducer of claim 1, said pattern of electrodes operate to provide focused reception of a reflected acoustic wave.

3. The transducer of claim 1, wherein said piezoelectric material comprises lead metaniobate.

4. The transducer of claim 1, wherein said disk is circular with a thickness-to-diameter aspect ratio greater than 0.0625.

5. The transducer of claim 4, wherein said pattern of electrodes includes a central disk surrounded by a series of annular rings.

6. The transducer of claim 1, wherein said pattern of electrodes includes at least one annular ring.

7. The transducer of claim 1, further comprising a backing material to which the disk is mounted.

8. The transducer of claim 7, further comprising an encapsulation layer that encloses the disk, electrodes, and backing material to enable the transducer to operate in a downhole environment.

9. An acoustic logging tool that comprises:

a focused acoustic transducer that employs an ungrooved planar piece of piezoelectric material having a low planar coupling coefficient and low Poisson's ratio; and electronics coupled to electrodes of the focused acoustic transducer to transmit or receive acoustic signals in a phased relationship.

10. The tool of claim 9, further comprising a wireline sonde that houses the electronics and focused acoustic transducer.

11. The tool of claim 9, further comprising a drill collar that houses the electronics and focused acoustic transducer.

12. The tool of claim 9, further comprising position and orientation sensors that associate acoustic measurements with a position on the borehole wall.

13. The tool of claim 9, wherein the acoustic signals comprise pulses and wherein the electronics measure travel time of the pulses.

14. The tool of claim 9, wherein the electronics measure amplitude of received acoustic signals.

15. The tool of claim 9, wherein the planar piece of piezoelectric material is a circular disk with a thickness-to-diameter ratio greater than 0.0625.

16. An acoustic transducer manufacturing method comprising:

forming a disk from piezoelectric material having a low planar coupling coefficient and low Poisson's ratio;

creating a pattern of electrodes on one flat, smooth surface of the disk and a reference electrode on an opposite surface of the disk, wherein said creating does not include cutting deep grooves to define and isolate the electrodes;

attaching at least one lead to each of the electrodes in the pattern of electrodes;

attaching the disk to a backing material; and encapsulating the disk and backing material.

17. The method of claim 16, wherein the disk has thickness-to-diameter ratio greater than 0.0625, and wherein said pattern of electrodes includes at least one annular ring.

18. The method of claim 16, wherein the piezoelectric material comprises lead metaniobate and has a planar coupling coefficient of less than 0.05 and Poisson's ratio less than 0.2.

19. The method of claim 16, wherein the backing material comprises a mixture of polymer and tungsten.

20. The method of claim 16, wherein said encapsulating includes providing a housing comprising glass-filled PEEK.

* * * * *